US005632124A

United States Patent [19]

Weingarten et al.

[11] Patent Number: 5,632,124

[45] Date of Patent: May 27, 1997

[54] CIRCULAR STAIRWAY AND METHOD OF MAKING SAME

[76] Inventors: David M. Weingarten; Lucia E. Howard, both of 1150 Estates Dr., Lafayette, Calif. 94549

[21] Appl. No.: 595,863

[22] Filed: Feb. 6, 1996

[51] Int. Cl.[6] ..... E04F 11/00

[52] U.S. Cl. ..... 52/187; 52/741.2; 182/187

[58] Field of Search ..... 52/187, 182, 191, 52/741.14, 741.2; 182/187

[56] References Cited

U.S. PATENT DOCUMENTS

| | | | |
|---|---|---|---|
| 415,078 | 11/1889 | Wagner . | |
| 4,190,992 | 3/1980 | Takenaga | 52/187 |
| 4,338,751 | 7/1982 | Sanders | 52/187 |
| 4,413,460 | 11/1983 | Gerlach | 52/741 |
| 4,527,367 | 7/1985 | Morellini | 52/187 |
| 4,587,780 | 5/1986 | Rorke | 52/187 |
| 4,850,164 | 7/1989 | McLeod | 52/182 |
| 4,918,799 | 4/1990 | Benedetti | 29/467 |
| 5,058,339 | 10/1991 | Krstovic | 52/187 |

FOREIGN PATENT DOCUMENTS

| | | | |
|---|---|---|---|
| 560 305 | 2/1975 | Switzerland | E04F 11/02 |

*Primary Examiner*—Creighton Smith

*Attorney, Agent, or Firm*—Claude A. S. Hamrick

[57] ABSTRACT

A circular stairway and method of making same, including a helical newel formed by installing a cylindrical tube or pipe with its longitudinal axis concentric with the vertical axis about which the circular staircase is to wind. The treads are then affixed to the tube in either cantilever fashion or are bridged between the tube and an outer wall. The tube is subsequently cut along helically extending lines disposed beneath the tread line and at approximately the handrail elevation. The tube material between these lines is then removed to leave a helically extending ribbon of tube material forming the tread supporting helical newel. As an alternative, the several components of the stairway can be pre-fabricated and transported to a site for assembly.

16 Claims, 5 Drawing Sheets

CIRCULAR STAIRWAY AND METHOD OF MAKING SAME

BACKGROUND OF THE INVENTION

1. Field of the Invention

The present invention relates generally to stairways, and more particularly to a circular stairway and method for manufacture thereof wherein one or more flights of stairs are attached to and supported by a helical newel cut from a rigid tube or cylinder.

2. Description of the Prior Art

Previously, curved stairways have either been spiral or circular. Spiral stairways typically have the treads attached to either a solid or hollow cylinder, column or newel of relatively small diameter. As a consequence, the inner run of the treads is normally very narrow, resulting in a significant risk of tripping or slipping to a lower stair. Most spiral stairways involve modular construction of some or all of the stairway, including the supporting newel, treads, and in some cases even a spiral-shaped outer stringer. Patents disclosing modular spiral stair construction include McCloud U.S. Pat. No. 4,850,164 for "Multi-Unit Stair Construction and Method" which discloses the use of a narrow inner column with modular attachments; Rorke U.S. Pat. No. 4,587,780 for a spiral staircase having a perforated narrow inner column for tread attachments; Morellini U.S. Pat. No. 4,527,367 entitled "Spiral Staircase" combines a narrow modular center column and treads; Gerlach U.S. Pat. No. 4,413,460 discloses use of a narrow two-piece center column; Sanders U.S. Pat. No. 4,338,751 teaches the use of a narrow modular center column; Takenaga et al. U.S. Pat. No. 4,190,992 provides a narrow inner column with modular attachments; and Brauckmann et al. Swiss Patent No. 560, 305.

When the center column is made with a larger diameter, more visibility up and down the stairway usually results, and the stairway is usually referred to as a "circular" stairway. Circular stairways have been used since the Middle Ages as a means of providing passage from one floor level to another. Typical constructions included spanning stairs between a rounded central wall and an outer wall, somewhat like that illustrated in WIPO Publication WO92/03625; cantilevering of the stairs from a central newel post, like that disclosed in U.S. Pat. No. 415,078 to Wagner; cantilevering the stairs from a cylindrical outer wall; supporting the stairs on one or more helically formed stringers, as illustrated in the patents to Krstovic (U.S. Pat. No. 5,058,339) and Benedetti (U.S. Pat. No. 4,918,799).

While reducing some of the problems associated with the narrow inner tread runs and poor visibility of spiral staircases, circular stairways normally require complex construction for structural support. As disclosed in Benedetti and Krstovic, the additional structural support is provided by formed stringers affixed to both inner and outer ends of each tread. The forming of the stringers obviously necessitates additional labor and alignment, and often requires the use of complex tools and jigs to hold and align the stringer materials as they are formed. Krstovic suggests that traditionally constructed circular stairways may even require additional structural supports in the form of cross-bracing between the stringers.

There is thus a need for a circular stairway design having a radius of curvature such that the inner run of the treads is wide enough to step upon without risk of slipping to a lower stair, and having an open configuration so as not to block visibility up and down the staircase. There is also a need for a simpler and less expensive method of making circular stairs.

SUMMARY OF THE INVENTION

Accordingly, it is an object of the present invention to provide a circular staircase having a wide inner tread run and clear visibility, and utilizing a single helical newel to provide support for the treads.

Another object of the present invention is to provide a method of constructing a circular staircase free of the alignment and labor problems normally encountered in the construction of helical stringers.

Still another object of the present invention is to provide a method of constructing a circular staircase by initially affixing the treads to a vertically mounted tube of relatively large diameter and then removing a helical strip of excess tube material above and below the tread attachment portions, thereby leaving a helical newel supporting the treads.

Briefly, a presently preferred embodiment of the present invention includes a generally helical newel formed by first installing a cylindrical tube or pipe with its longitudinal axis concentric with the vertical axis about which the circular staircase is to wind. The treads are then affixed to the tube in either cantilever fashion or bridged between the tube and an outer wall. The tube is then cut along generally helically extending lines disposed beneath the tread line and at approximately the handrail elevation. The tube material between these lines is then removed to leave a helically extending ribbon of tube material forming the tread supporting helical newel.

Among the advantages of the present invention is that it provides a method of building a circular staircase that does not require the use of complex alignment tools and jigs.

Another advantage of the present invention is that it provides a circular staircase that is open and provides excellent user visibility.

Still another advantage of the present invention is that it provides a staircase having treads that are of reasonable width over substantially all of their useful width.

These and other objects and advantages of the present invention will become apparent to those skilled in the art after having read the following detailed description of the preferred embodiment.

IN THE DRAWING

DETAILED DESCRIPTION OF THE PREFERRED EMBODIMENTS

Figure 1:
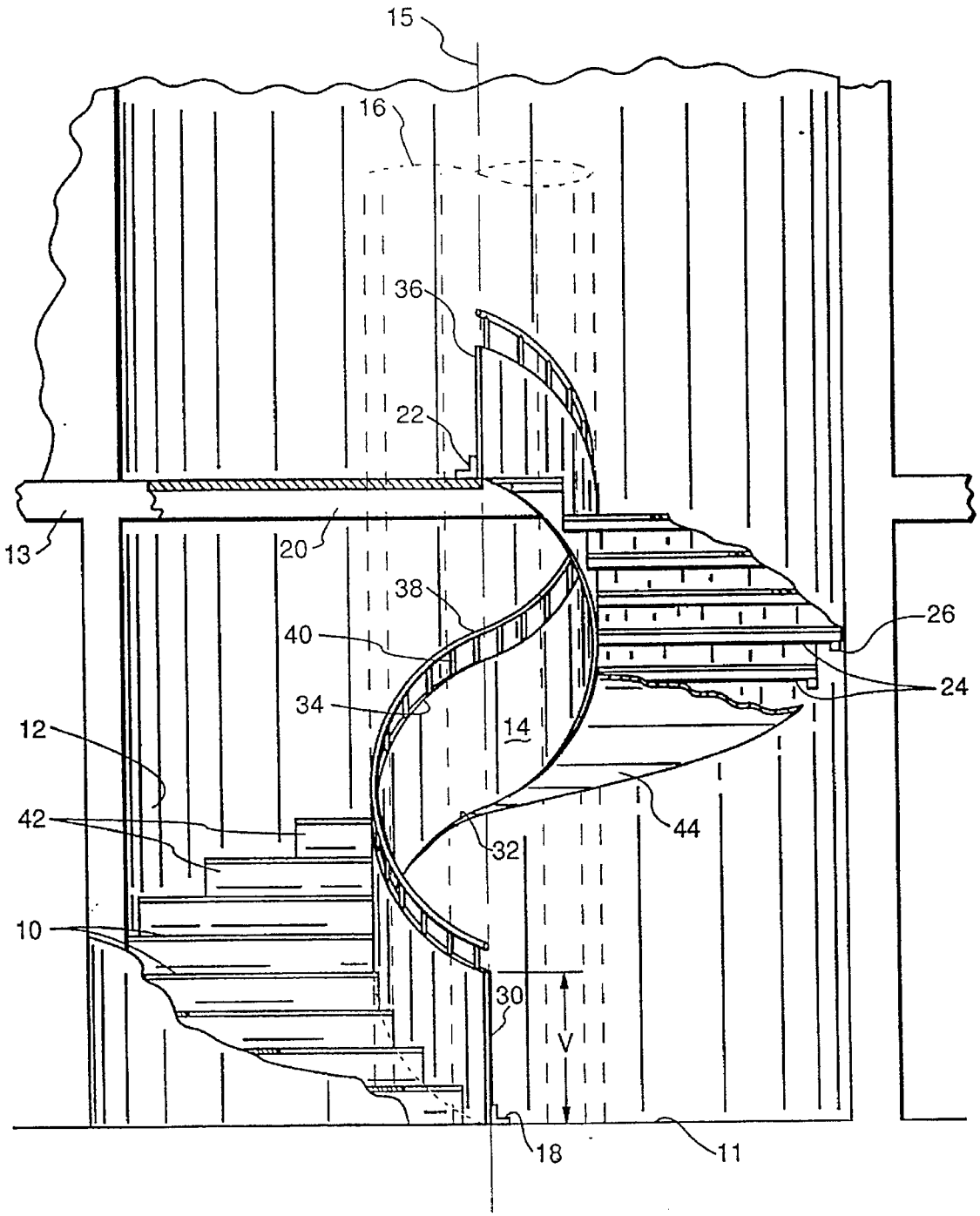
FIG. 1 is a partially broken elevational view illustrating a circular staircase in accordance with the present invention.

Referring now to FIG. 1, a circular staircase in accordance with the present invention is illustrated partially broken away to reveal certain details of its construction. As depicted, a plurality of treads 10 are spanned between an outer cylindrical wall 12 and a helical newel formed by cutting the ribbon-shaped structure 14 from a cylindrical pipe or tube depicted by the dashed lines 16. In fabricating the stairway, one would normally first construct the lower floor or supporting foundation 11, the cylindrical outer wall 12, and the associated second floor superstructure 13, and locate the vertical centerline 15. He would then install the tube 16 in a position coaxial relative to the centerline 15 and the wall 12, fastening it in place by securing it to the floor 11 with brackets 18 and to the second level joist or floor 20 with suitable brackets 22. Suitable tread-supporting brackets or platforms 24 would then be attached between the outer surface of the tube 16 and the wall as indicated at 26. Tube 16 would then be suitably marked to delineate cutlines 30, 32, 34 and 36, and suitable sawing apparatus or cutting torch devices would be used to trim the helical newel 14 from tube 16. After appropriate clean-up, a handrail 38 would be affixed either to the top edge of newel 14 by means of standoffs or risers 40. Thereafter, the treads 10 would be affixed to the support structures 26.

At this point, the stairway per se is complete, however if aesthetic considerations dictate, vertical riser panels may be installed, and the underside of the stairway can be boxed in or firred as indicated at 44 to enclose the bottom sides of the treads. Note that the outer wall 12 need not necessarily be cylindrical; it could be rectangular or of any other configuration.

In a preferred implementation of the present invention, the tube 16 is at least 3'0" in diameter with a wall thickness of ⅜". With a floor-to-floor height of 10'0" and the lower stair entry at 0°, and with risers of 7½", the exit will be at approximately 270°. Suitable tubular box beams or angles may be used for the tread supports 26 and can be either welded to the helical newel or bolted thereto.

The treads can be made of any suitable material and are affixed to the helical newel proximate the lowermost edge 32 of the ribbon-like member 14. The vertical dimension of the member 14 is typically between 24" and 48" depending on the thickness and strength of the tube material and the desired height of the handrail 38. With the vertical dimension V selected such that the uppermost edge of member 14 is at least 24" above the tops of the treads 10, risers 40 would be used to raise the handrail 38 to a height of at least 34" to satisfy typical building codes.

In an alternative design using a 3'0" diameter pipe with 3' treads leading up 9'0" from floor to floor, risers of 6.75" would be required with entry at 0° and exit at 270°.

In either embodiment, the tube 16 can be made of any suitable material including various metals and plastics, but must have acceptable resistance to fire. In addition to steel, the pipes may be of stainless steel or aluminum and, if of a thin-walled construction, can be combined with a second helical ribbon cut from a tube of lesser diameter with the two helixes being joined together after cutting, with plates welded top and bottom to form a helical box-like structure which can, if desired, be filled with a light fill material or expandable foam material to add rigidity, sound-dampening, etc.

Figure 2:
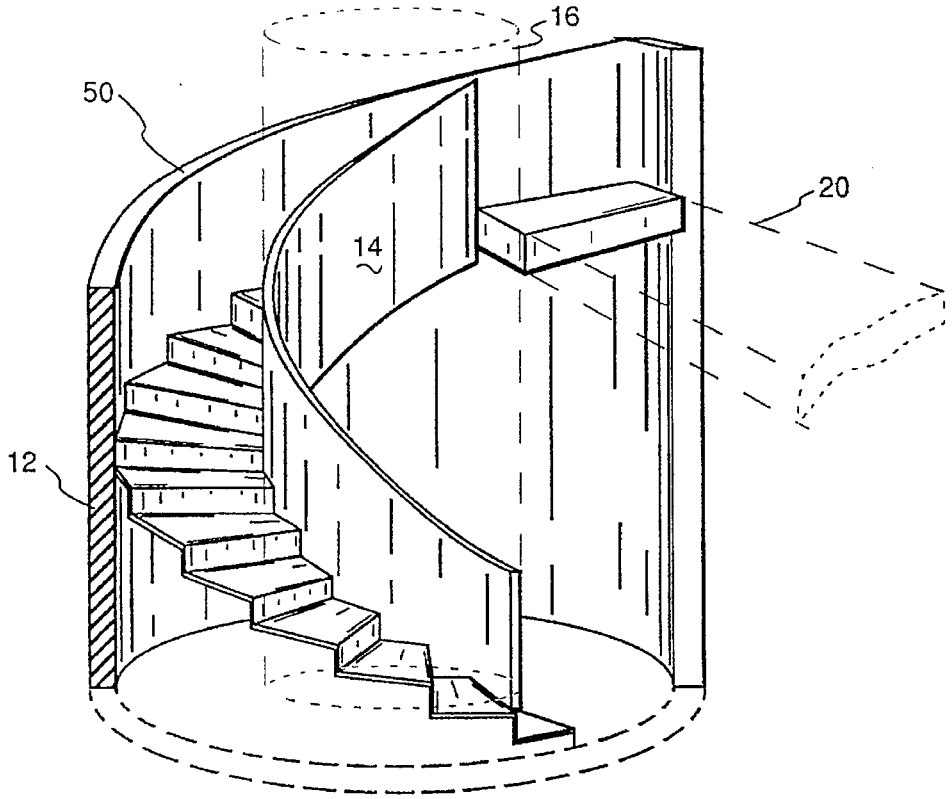
FIGS. 2 and 3 are perspective views schematically illustrating alternative embodiments of the present invention.

As further indicated in simplified detail in FIG. 2 of the drawing, the outer wall 12 may be trimmed at a suitable height 50 above the stair treads (at least 34" above the tread tops to meet most local codes) to provide an open stairway. In this case, the wall top could be configured to serve as a handrail.

Figure 3:
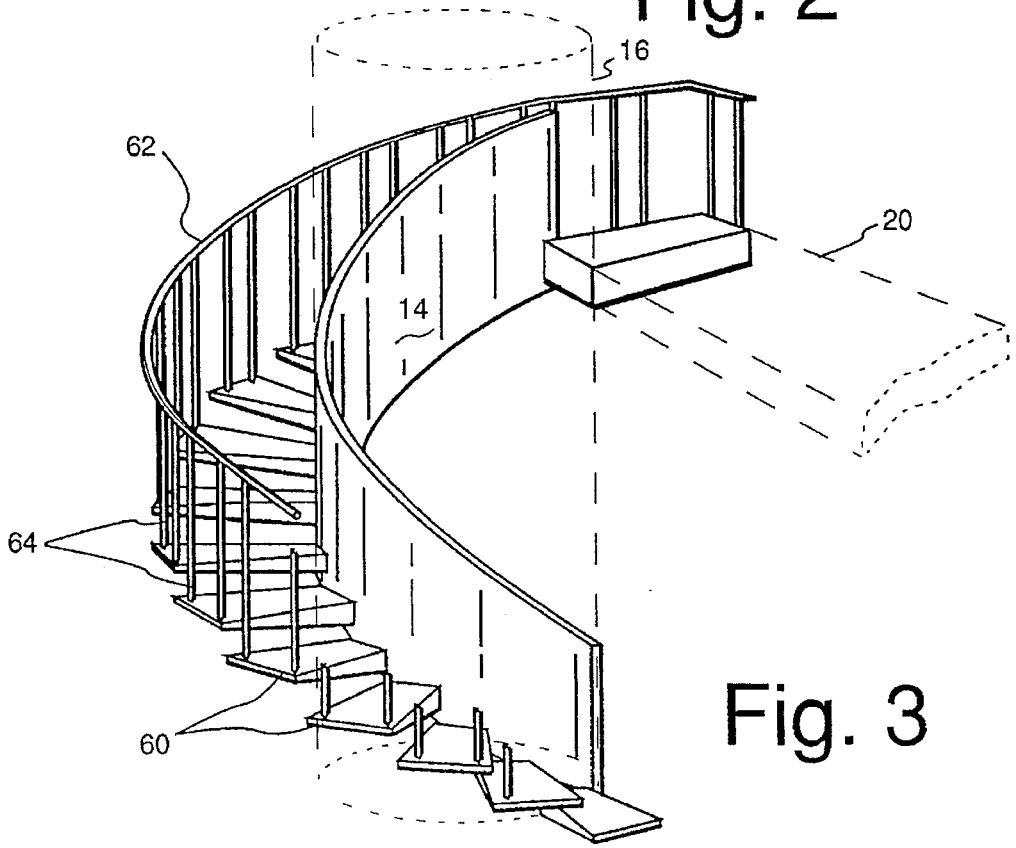

In another alternative illustrated in FIG. 3, cantilevered treads 60 are shown affixed to the helical newel 14, and a continuous handrail 62 supported by rods or balusters 64 affixed to the distal ends of the treads 60 provide an aesthetically pleasing and open stairway leading up to the landing 20.

In addition to the railing types illustrated, the exterior railing could be constructed of numerous materials and in varied designs. For example, solid sheet metal, wood or plastic, or perforated metal or woven wire panels could be spanned between vertical posts positioned at regular or irregular intervals up the stairway. Alternatively, cable could be wound through or around vertical supports, and straight or curved wooden panels could be supported from metal or wood posts.

Figure 4:
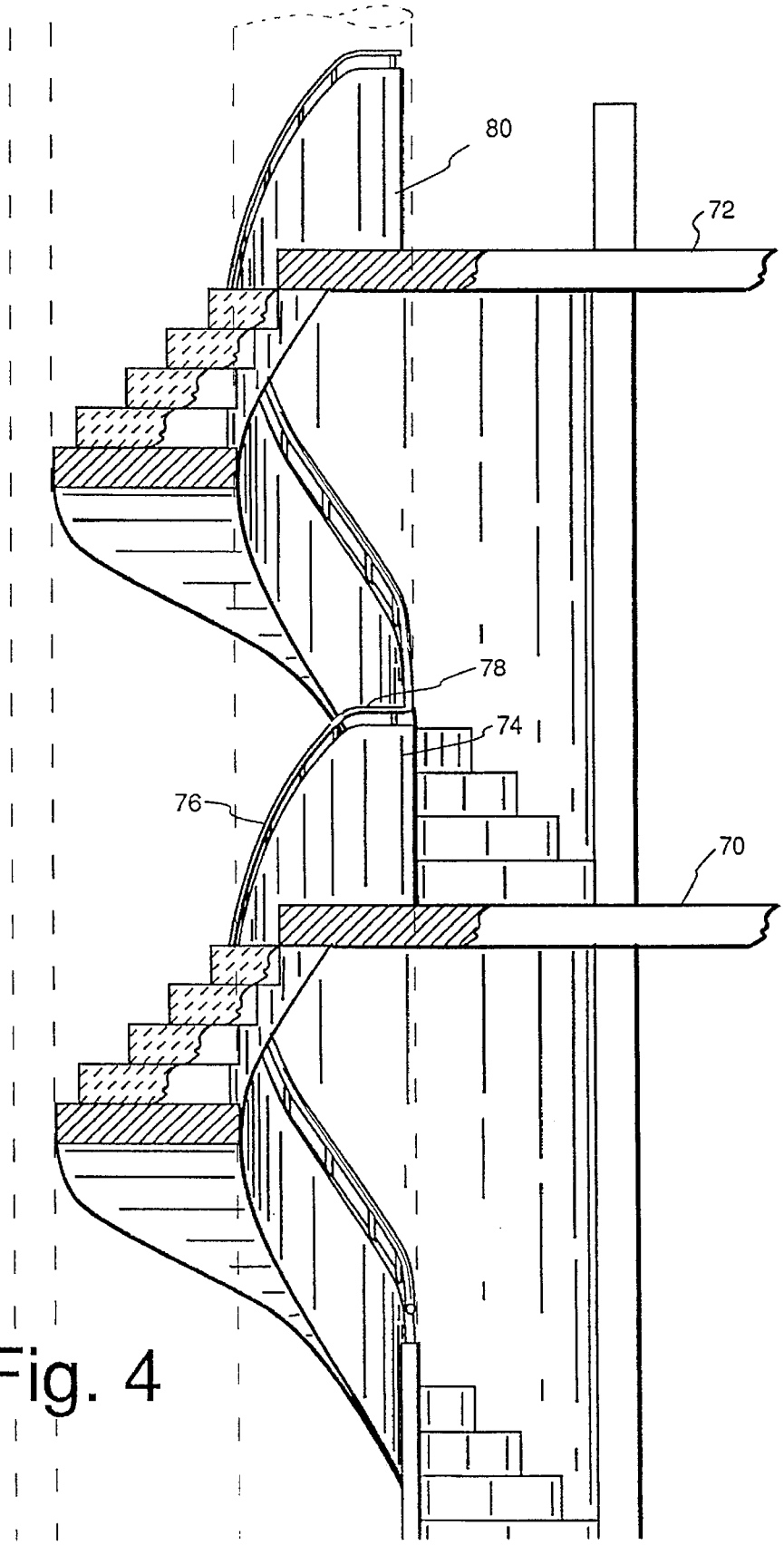
FIGS. 4–6 are partially broken elevational views illustrating alternative embodiments of the present invention.
Figure 5:
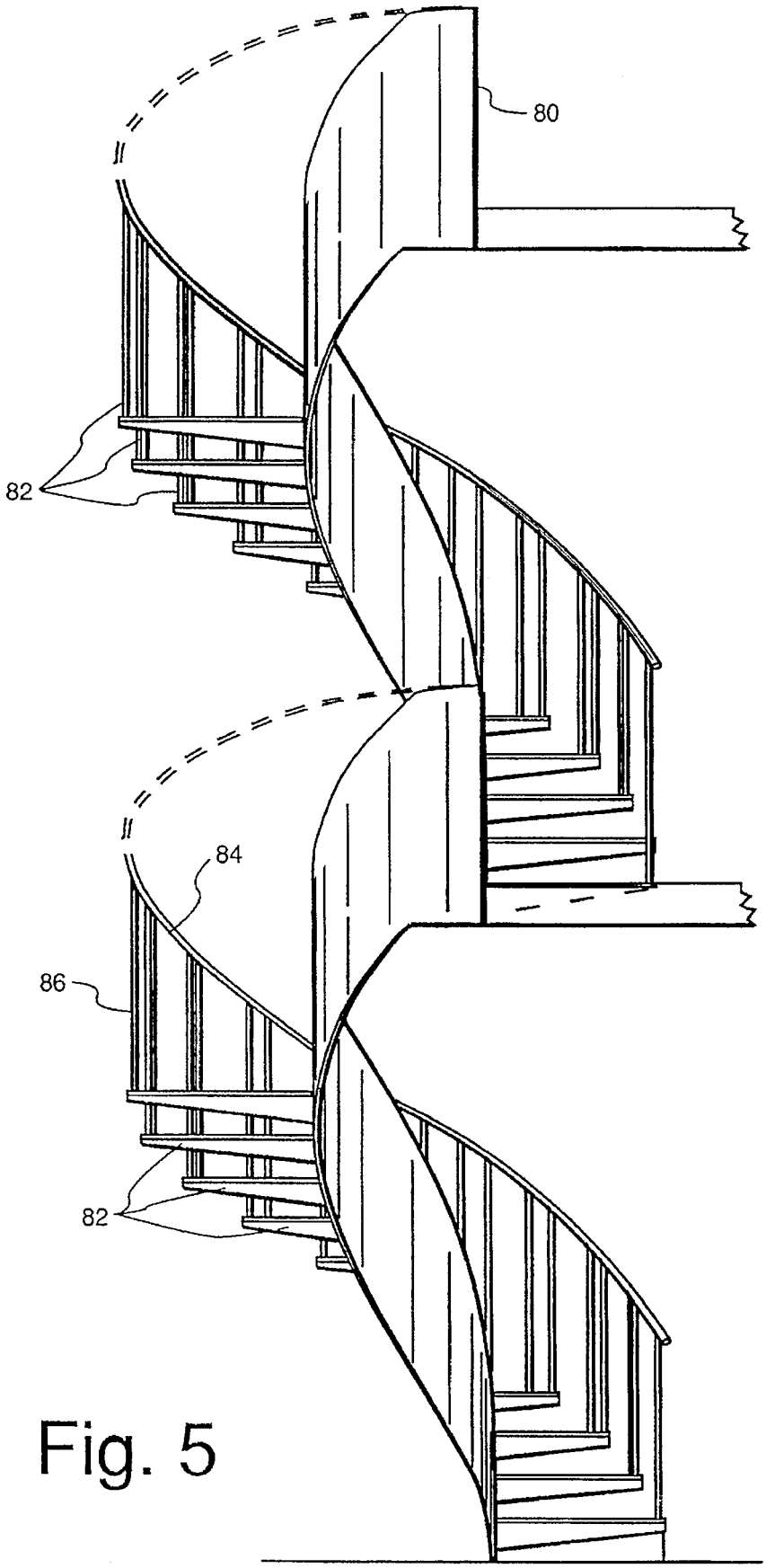
Figure 6:
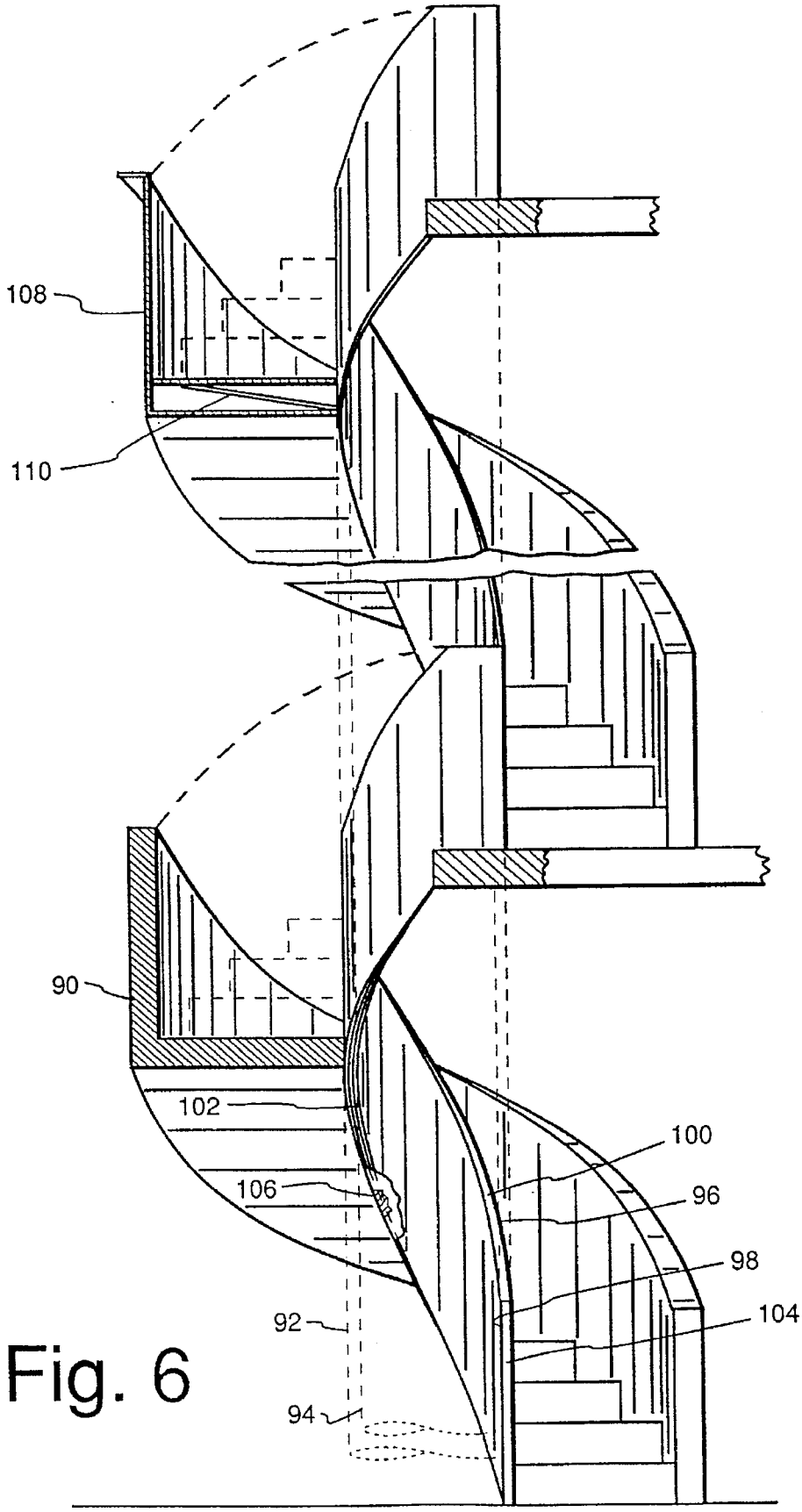

Extensions of the alternative shown in FIGS. 1, 2 and 3 configured for multiple level landings are depicted in FIGS. 4, 5 and 6. In these examples, in order to accommodate multiple landings 70 and 72, it will be appreciated that the helical newel structure will not be strictly helical along its entire length in that it will include at least one partially cylindrical segment 74 of approximately 90° in order to accommodate the second floor landing 70 and provide a horizontal transition of the rail 76 as indicated at 78. The upper end 80 will be terminated at any angle that is appropriate.

In FIG. 5, similar cantilevered tread structure with rail 84 and balusters 86 is depicted at 82.

In FIG. 6, still another alternative is depicted, including an outer railing 90 that can be built up of usual building materials supported by cantilevered treads. As depicted in the lower portion of the Figure, it will be noted that this embodiment of the newel is fabricated from two thin-walled tubes 92 and 94, the edges 96 and 98 of which are joined together by a narrow top plate 100, a narrow bottom plate 102 and an end plate 104. The resulting box-like structure may be left hollow or may be filled with a suitable light-weight material 106, as suggested above. As yet another variation, another rigid helical ribbon-like structure 108 could be cut from a larger diameter tube or be formed such that, when affixed to the ends of cantilevered treads 110, it supplies both a barrier and railing.

It is anticipated that the present invention will have application in numerous architectural designs and will be implemented in a wide range of tube sizes. For example, it is believed that tube sizes ranging from approximately 2'6" to approximately 5'0" are feasible. Tube size, for example, may be selected to accommodate selected trend rise heights and landing elevations and exit angles. Furthermore, additions to fabrication in situ, the helical newel may be fabricated ex situ and transported to its final destination for installation. In such case, suitable stiffeners would be attached to maintain the integrity of the helix during transit. Such stiffeners could then be removed at the installation site before or after the treads are affixed.

It is also contemplated that tubes of other cross-sections could be used to form the helical newel. For example, in order to achieve certain architectural design objectives, tubes of elliptical, triangular, rectangular, pentagonal, polygonal, etc. cross-sections may be used.

It will thus be appreciated that, in accordance with the present invention, a novel method of constructing a circular staircase is provided that is relatively inexpensive to construct, does not require complicated jigs or bending structures, and can be made using available materials. Although the present invention has been described above in terms of specific embodiments, it is anticipated that alterations and modifications thereof will no doubt become apparent to those skilled in the art. For example, once the helical newel has been fabricated, numerous types of trim and decorative treatment can be formed or applied to, or hung from the newel structure to achieve desired architectural effects. It is therefore intended that the following claims be interpreted as covering all such alterations and modifications as fall within the true spirit and scope of the invention.

What is claimed is:

1. A circular staircase comprising:

a helical newel including a ribbon-like member cut from a tube having a longitudinal axis and a diameter of at least 2'6", said ribbon-like member being helical in configuration, rigidly attached to a support structure and having an axis of revolution lying along a vertical line normal to a horizontal base; and a plurality of stair treads affixed to said ribbon-like member and extending radially outwardly relative to said axis of revolution, said stair treads being disposed at regular increments along said ribbon-like member.

2. A circular staircase as recited in claim 1 wherein said stair treads are rigidly affixed to and supported by said helical newel in cantilevered fashion.

3. A circular staircase as recited in claim 1 and further comprising a generally cylindrical outer wall concentric with and at least partially surrounding said helical newel, said plurality of stair treads having distal extremities secured to said outer wall and being supported thereby.

4. A circular staircase as recited in claim 1 and further comprising means forming a handrail disposed along an upper edge of said ribbon-like member.

5. A circular staircase as recited in claim 1 wherein said stair treads are affixed to said helical newel proximate its lowermost edge.

6. A circular staircase as recited in claim 5 wherein an uppermost edge of said helical newel is at least 24 inches above an upper surface of each said stair tread.

7. A circular staircase as recited in claim 1 wherein a lowermost stair tread is disposed at a radial position of substantially 0° about said axis of revolution and an uppermost stair tread is disposed at a radial position of approximately 270° about said axis of revolution.

8. A circular staircase as recited in claim 1 wherein said ribbon-like member includes a first generally helical portion extending from a first level base to a second level landing, a second generally partially cylindrical portion at said second level, and a third generally helical portion extending from said second level to a third level landing.

9. A circular staircase as recited in claim 8 wherein said first portion extends approximately 270° around said axis of revolution and said second portion extends approximately 90° around said axis of revolution.

10. A circular staircase as recited in claim 1 wherein said helical newel includes another ribbon-like member cut from another cylindrical tube having a diameter less than that of the first-mentioned tube, the two ribbon-like members being affixed to each other to increase the rigidity of said helical newel.

11. A method of making a circular staircase comprising the steps of:

mounting a length of first tube having a central axis and a diameter of at least 2'6" so that said central axis extends in a vertical direction;

severing a strip of material from said tube leaving a generally helical first ribbon-like member forming a rigid helical newel; and affixing a plurality of stair treads to said ribbon-like member said stair treads extending radially away from said central axis.

12. A method of making a circular staircase as recited in claim 11 and further comprising forming a handrail along an upper edge of said ribbon-like member.

13. A method of making a circular staircase as recited in claim 11 wherein said stair treads are affixed to said helical ribbon-like member proximate a lowermost edge thereof.

14. A method of making a circular staircase as recited in claim 11 wherein an uppermost edge of said helical ribbon-like member is at least 24 inches above an upper surface of each said stair tread.

15. A method of making a circular staircase as recited in claim 11 wherein a lowermost stair tread is disposed at a radial position of substantially 0° about said central axis, and an uppermost stair tread is disposed at a radial position of approximately 270° about said axis.

16. A method of making a circular staircase as recited in claim 11 wherein said helical newel includes a second ribbon-like member cut from another cylindrical tube having a diameter less than that of the first-mentioned tube, the two ribbon-like members being affixed to each other to increase the rigidity of said helical newel.

* * * * *